US008701783B2

(12) United States Patent
Buytaert et al.

(10) Patent No.: US 8,701,783 B2
(45) Date of Patent: Apr. 22, 2014

(54) APPARATUS FOR AND METHOD OF DEPLOYING A CENTRALIZER INSTALLED ON AN EXPANDABLE CASING STRING

(75) Inventors: Jean Buytaert, Mineral Wells, TX (US); Eugene Edward Miller, Weatherford, TX (US)

(73) Assignee: Antelope Oil Tool & Mfg. Co., LLC, Mineral Wells, TX (US)

( * ) Notice: Subject to any disclaimer, the term of this patent is extended or adjusted under 35 U.S.C. 154(b) by 1682 days.

(21) Appl. No.: 11/828,943

(22) Filed: Jul. 26, 2007

(65) Prior Publication Data

US 2009/0025929 A1 Jan. 29, 2009

(51) Int. Cl.
*E21B 17/10* (2006.01)

(52) U.S. Cl.
USPC ..... 166/376; 166/213; 166/241.6

(58) Field of Classification Search
USPC ..... 166/376, 380, 213, 207, 241.6, 384
See application file for complete search history.

(56) References Cited

U.S. PATENT DOCUMENTS

| | | | |
|---|---|---|---|
| 2,312,600 | A | 3/1943 | Steps |
| 2,718,266 | A | 9/1955 | Berry et al. |
| 3,124,196 | A | 3/1965 | Solum |
| 3,200,864 | A | 8/1965 | Solum et al. |
| 3,200,884 | A | 8/1965 | Solum et al. |
| 3,356,147 | A | 12/1967 | Dreyfuss |
| 3,566,965 | A | 3/1971 | Solum |
| 4,269,269 | A | 5/1981 | Wilson |
| 4,328,839 | A | 5/1982 | Lyons et al. |
| 4,545,436 | A | 10/1985 | Harrison |
| 4,641,776 | A | 2/1987 | Vlasek et al. |
| 4,651,823 | A | 3/1987 | Spikes |
| 4,688,636 | A | 8/1987 | Hennessey |
| 4,787,458 | A | 11/1988 | Langer |
| 5,238,062 | A | 8/1993 | Reinholdt |
| 5,261,488 | A | 11/1993 | Gullet et al. |
| 5,575,333 | A | 11/1996 | Lirette et al. |
| 5,908,072 | A | 6/1999 | Hawkins |
| 6,457,519 | B1 | 10/2002 | Buytaert et al. |
| 6,484,803 | B1 | 11/2002 | Gremillion |

(Continued)

FOREIGN PATENT DOCUMENTS

| | | |
|---|---|---|
| GB | 2148985 | 6/1985 |
| GB | 2403238 A | 12/2004 |

(Continued)

OTHER PUBLICATIONS

PCT/US2008/063097 International Search Report and Written Opinion, dated Sep. 9, 2008, 14 pages.

(Continued)

*Primary Examiner* — David Andrews
(74) *Attorney, Agent, or Firm* — MH2 Technology Law Group, LLP

(57) ABSTRACT

A method of and apparatus for deploying a bow spring centralizer installed on an expandable casing string and restrained in the collapsed configuration by restraining bands that rupture, upon expansion of the casing string, to deploy the bow spring centralizer and provide stand-off between the expanded casing string and the wall of the borehole. In one embodiment, the bow spring centralizer comprises landings for receiving and retaining the bands for restraining the centralizer in the collapsed configuration. In another embodiment, the bands are secured to the centralizer to prevent separation of the ruptured bands from the deployed centralizer.

17 Claims, 5 Drawing Sheets

(56) References Cited

U.S. PATENT DOCUMENTS

| | | | | |
|---|---|---|---|---|
| 6,679,325 | B2 | 1/2004 | Buytaert | |
| 6,725,939 | B2 | 4/2004 | Richard | |
| 6,871,706 | B2 | 3/2005 | Hennessey | |
| 7,143,848 | B2 | 12/2005 | Armell | |
| 6,997,254 | B2 | 2/2006 | Jenner | |
| 7,096,939 | B2 | 8/2006 | Kirk et al. | |
| 7,624,798 | B2 | 12/2009 | Presslie et al. | |
| 2002/0139537 | A1 | 10/2002 | Young et al. | |
| 2002/0139538 | A1 | 10/2002 | Young et al. | |
| 2003/0000607 | A1 | 1/2003 | Jenner | |
| 2003/0230411 | A1* | 12/2003 | Richard | 166/384 |
| 2008/0115972 | A1 | 5/2008 | Lynde et al. | |

FOREIGN PATENT DOCUMENTS

| | | |
|---|---|---|
| WO | WO 9108374 | 6/1991 |
| WO | WO9954714 A | 12/1999 |
| WO | WO2005107395 | 11/2005 |

OTHER PUBLICATIONS

PCT/US2008/053163 International Search Invite to Pay, dated Sep. 11, 2008, 6 pages.
PCT/US2008/068891 International Search Report and Written Opinion, dated Sep. 29, 2008, 11 pages.
U.S. Appl. No. 11/749,544 "Low Clearance Centralizer and Method of Making Centralizer" filed May 16, 2007.
U.S. Appl. No. 12/042,989, Expandable Centralizer for Expandable Pipe String, filed Mar. 5, 2008.
PCT/US2008/063163 International Search Report and Written Opinion, dated Nov. 28, 2008, 19 pages.
Focus on New Technology; Fall 2007; 1 page.
PCT/US2008/068891, "PCT International Preliminary Report on Patentability", Feb. 4, 2010, 7 pages.

* cited by examiner

APPARATUS FOR AND METHOD OF DEPLOYING A CENTRALIZER INSTALLED ON AN EXPANDABLE CASING STRING

BACKGROUND

1. Field of Invention

The present invention is directed to an expandable centralizer for centering an expandable casing string within a borehole. More specifically, the present invention is directed to an apparatus for and a method of deploying an expandable centralizer after it is installed on an expandable casing string and run into a borehole to generally center an expandable casing string at a desired position within the borehole.

2. Background of Related Art

Centralizers are commonly secured at intervals along a pipe string, such as a casing string, to provide stand-off between the exterior wall of the casing string and the wall of a borehole in which the casing string is installed. The centralizers generally include a plurality of angularly distributed ribs that project radially outwardly from axis of the casing string to provide "stand-off" between the wall of the borehole and the casing string. Centralizers ideally center the casing string within the borehole to provide a generally uniform annulus between the casing string and the wall of the borehole. Positioning of the casing string within a borehole promotes uniform distribution of cement slurry around the casing string to form a protective liner that reinforces the casing string, isolates the casing string from corrosive formation fluids, and prevents unwanted fluid flow between penetrated geologic formations.

A bow-spring centralizer employs flexible bow-springs as the ribs to provide stand-off. Bow-spring centralizers typically include a pair of axially-spaced and generally aligned collars that are coupled one to the other by multiple curved bow-springs. The bow-springs are predisposed to bow outwardly away from the axis of the centralizer to engage the borehole and to center a casing string received through the aligned bores of the spaced-apart collars. Configured in this manner, the bow-springs provide stand-off from the borehole, but flex inwardly to cooperate with borehole obstructions, such as tight spots or protrusions into the borehole, as the casing string is installed into the desired interval of the borehole. Bow springs are generally cold formed, heat treated and otherwise forged, shaped or adapted to collapse to lie generally along the length of the casing and to spring back to substantially their original bowed shape to maintain the desired stand-off between the casing string and the borehole.

Casings strings having centralizers installed thereon are generally run into boreholes using force to overcome the resistance of the bow springs. A deployed bow spring centralizer generally engages the interior wall of a previously installed casing string, or the wall of the borehole, through multiple or all bow springs at any given position in a borehole. If bow spring centralizers are secured at generally uniform intervals along the length of a casing string, the cumulative amount of resistance due to the frictional drag on each bow spring can be large. Each deployed bow spring contributes to the overall resistance to movement of the casing string within the borehole, such as when the casing string is being positioned in the borehole for cementing. Also, the force necessary to collapse the bow springs of a centralizer to cause them to lie against the casing on which the centralizer is installed and to thereby pass a borehole restriction may be many times the resistance force that must be overcome to move the collapsed centralizer through the borehole restriction. Accordingly, it may be preferred to run the centralizers into the surface end of the borehole in a collapsed configuration if the centralizers can be reliably deployed after the casing string is positioned at the targeted borehole interval.

Some centralizers have been adapted to withstand expansion, along with the casing string, and generally provide stand-off between the expanded casing string and the borehole. Other centralizers have been adapted for being run into the borehole after being installed on a casing string, but restrained in a collapsed configuration to minimize the resistance to movement of the casing string through the borehole and to the targeted interval of the borehole. However, the known methods of deploying a collapsed and restrained bow spring centralizer within the targeted interval of a borehole are often complicated or involve the use of strong chemical agents. For example, in U.S. Pat. No. 5,261,488, a method of deploying a restrained centralizer by dissolving or degrading a titanium band using hydrofluoric acid is disclosed. These types of chemical agents may damage other structures or present a hazard to personnel that ship or handle the agents at the surface.

What is needed is a method for installing an expandable centralizer on a casing string, restraining the expandable centralizer in a collapsed configuration, installing the casing string in the targeted interval of a borehole and then deploying the expandable centralizer to provide stand-off between the casing string and the borehole. What is needed is a method of restraining an expandable centralizer in its collapsed configuration to facilitate installation of the casing string in a targeted interval in a borehole, and a method of deploying the centralizer (after the casing string is run into the borehole to the targeted interval) that does not require the introduction of strong chemical agents into the borehole, complicated mechanisms or difficult manipulations of the casing string. What is needed is an expandable centralizer that reliably deploys simultaneously upon expansion. What is needed is an expandable centralizer that is controllably deployable within the borehole at or near the position in which the centralizer is cemented within the annulus. What is needed is a centralizer that is simultaneously expandable and deployable to provide stand-off between a casing and a borehole.

SUMMARY

The present invention satisfies some or all of the above-referenced needs. The present invention is directed to a method of deploying an expandable centralizer within a borehole. In one embodiment, the method includes the steps of collapsing the bow springs of the expandable centralizer to a collapsed position to lie generally along the exterior wall of the casing string on which the centralizer is installed, securing the bow springs in the collapsed position using one or more tensile bands, installing the casing string and the expandable centralizer in the targeted interval of the borehole and expanding the casing string, the centralizer and the band to cause the band to fail and release the bow springs to their deployed configuration.

The bands used to restrain the bow-springs of the centralizer of the present invention may be mechanically and/or metallurgically conditioned to resist expansion along with the casing string and the collars of the centralizer. Accordingly, the bands are predisposed to fail upon expansion of the casing string to deploy the bow springs and to provide stand-off between the expanded casing string and the borehole.

The expandability of the centralizer of the present invention depends heavily on the selected material and the structure of the expandable centralizer components, but generally is 10 to 25% over the original diameter. For example, but not by way of limitation, a 7.625-inch outside diameter casing string fitted with a plurality of expandable centralizers having opposed collars that are approximately 8 inches in outside diameter may be easily installed in a targeted interval of a borehole using the present invention by restraining the bow springs in the collapsed configuration using restraining bands. The centralizers may then be expanded within the borehole to 9.625 inches in diameter. The expandable centralizers are restrained in the collapsed configuration using restraining bands that are not as expandable as the casing string or the collars of the centralizer. As a result, the expansion of the casing string and the collars of each expandable centralizer ruptures the restraining bands to automatically deploy the bow springs and to provide desired stand-off between the expanded casing string and the borehole for improved cement placement.

The bow springs of the centralizer of the present invention may be collapsed using a variety of tools adapted for this application. One method includes the steps of forming a constrictable ring that is larger in diameter (in a plane perpendicular to the axis of the casing string) than the deployed span of at least a portion of the bow springs, forming threaded holes in the ring with at least one aligned with each bow spring, and threading and rotating a bolt within each threaded hole to contact and dispose the aligned bow spring inwardly to its collapsed position to generally lie along the exterior surface of the casing string. The restraining bands may then be installed on the centralizer to restrain the bow springs in their collapsed configuration until the casing string is expanded and the bow springs are deployed by sacrificial failure of the restraining bands. Alternately, the bow springs may be collapsed using a tensile circumferential banding tool similar to an oil filter wrench. Alternately, the bow springs may be collapsed by axially forcing the deployed bow springs into the interior bore of a sleeve that is smaller than the deployed span of the bow springs. The sleeve may be tapered and segmented so that it can be disassembled after the bow springs of the centralizer are collapsed to facilitate the installation of the restraining bands. Those skilled in the art will appreciate that there are many other methods of collapsing the bow springs of a bow spring centralizer to facilitate the installation of restraining bands.

The restraining bands may optionally be mechanically or metallurgically predisposed to fail at a particular portion of the band such as by milling, channeling, notching, necking or heat treating the band at a particular location. The band may be secured to one or more bow springs of the expandable centralizer to prevent the ruptured band from becoming inadvertently separated from the centralizer after deployment and lodged in rig equipment during subsequent well operations.

The expandable centralizer of the present invention may comprise expandable collars and bow springs that are integrally formed from a unitary piece of pipe to minimize or deter separation of the end of a bow spring from a collar as a result of forced collar expansion. A method of forming such a failure resistant expandable centralizer is described in U.S. application Ser. No. 11/749,544 entitled "Low-Clearance Centralizer and Method of Making Centralizer" filed on 16 May 2007. However, it is also within the scope of the present invention to use a welded or otherwise fastened connection to couple the end of a bow spring to an expandable collar.

The present invention may be used to install casing strings through the bore of earlier-installed casing strings that have already been cemented into a borehole. A smaller-diameter expandable casing string may be run into a borehole through a previously installed and larger-diameter casing string, and then forcibly expanded within a targeted interval of the borehole that is deeper than the previously installed, larger-diameter casing string to generally approximate the diameter of the previously installed, larger-diameter casing string. The expanded (formerly smaller-diameter) casing string is then cemented in place below the previously installed casing string to form what can be considered as an extension of the larger-diameter casing string.

BRIEF DESCRIPTION OF THE APPENDED DRAWINGS

Figure 7:
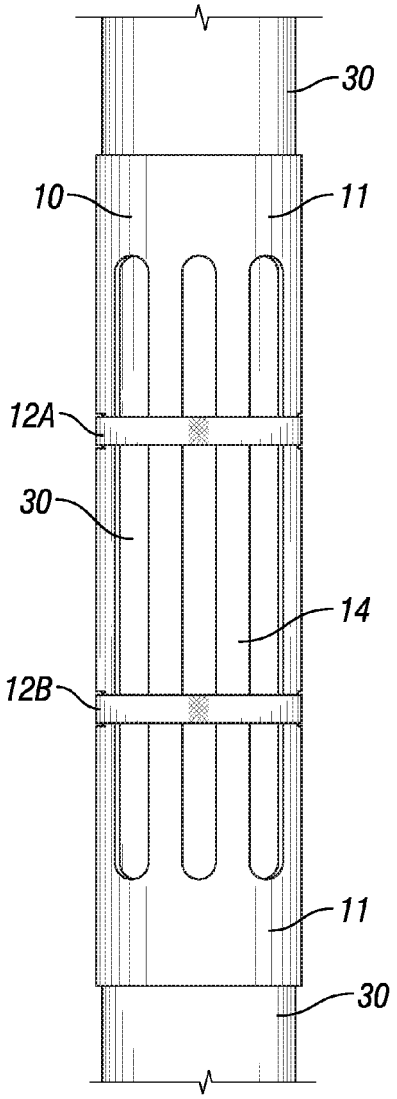
FIG. 7 is an enlarged elevation view of an expandable centralizer of FIG. 4 restrained in its collapsed configuration on an expandable casing string.
Figure 8:
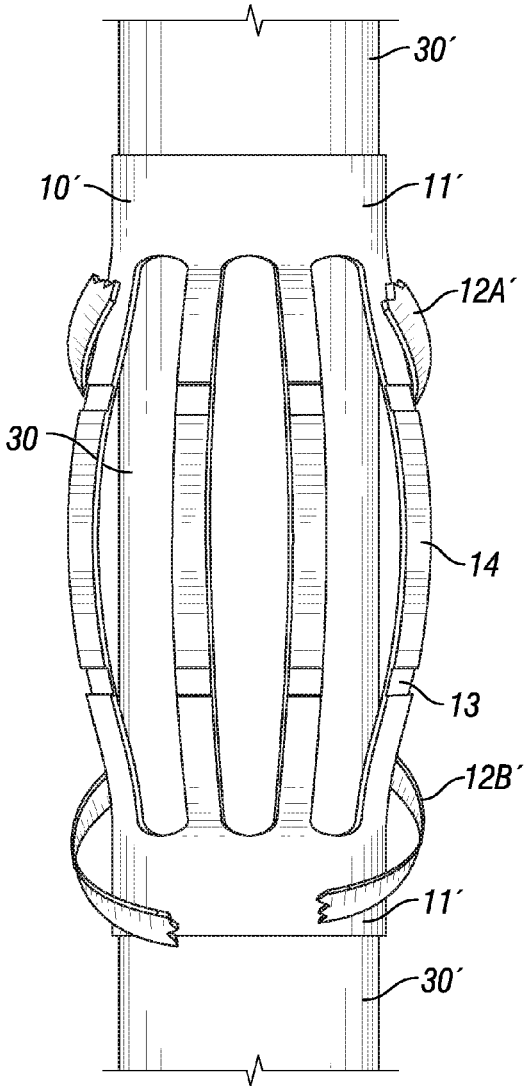

FIG. 8 is the enlarged elevation view of the expandable centralizer of FIG. 7 after the expansion mandrel has been forcibly moved through the bore of the expandable casing string and through the expandable centralizer to expand the casing string and the collars of the expandable centralizer, and to rupture the restraining bands to release the bow springs of the expandable centralizer to its deployed configuration.

Figure 9A:
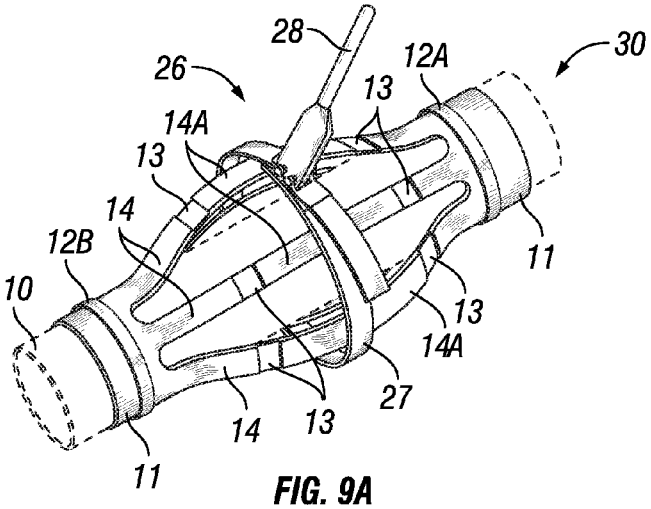

FIG. 9A is a perspective view of an expandable centralizer of the present invention with a bow spring collapsing tool disposed generally around the deployed middle portion of the bow springs of an expandable centralizer for forcing the bow springs to a collapsed configuration to facilitate the slidable installation of restraining bands.

Figure 9B:
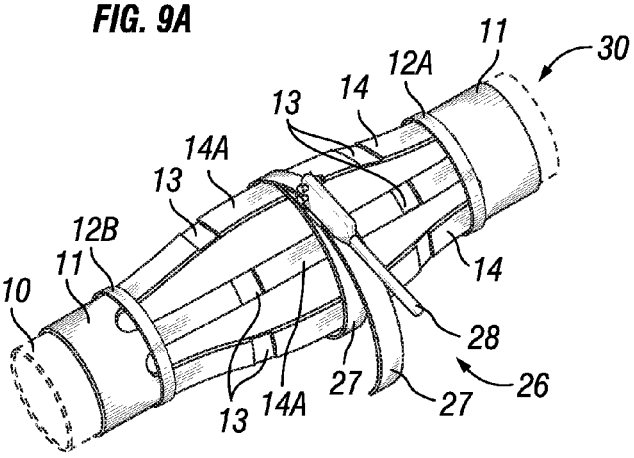

FIG. 9B is the perspective view of the expandable centralizer of FIG. 9A after the collapsing tool has been used to partially collapse the bow springs to their collapsed configuration.

Figure 9C:
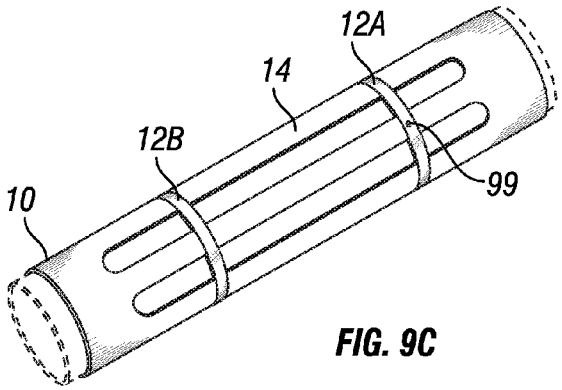

FIG. 9C is the perspective view of the expandable centralizer of FIG. 9C after the bow spring collapsing tool is used to completely collapse the bow springs of the expandable centralizer, and the restraining bands have been slidably installed onto the collapsed bow springs, and received and retained within milled channels on the bow springs, to retain the bow springs in their collapsed configuration.

DETAILED DESCRIPTION OF THE PRESENT INVENTION

The present invention is directed to a method of installing and later deploying an expandable centralizer that has been secured to an expandable casing string. The present invention is also directed to an expandable bow spring centralizer adapted for being installed on a casing string, collapsed to cause the bow springs to lie generally along a portion of the length of the expandable casing string, run into a borehole to a targeted interval while the bow springs are restrained in the collapsed configuration, and deployed within the borehole simultaneously upon expansion of the casing string and the centralizer to provide stand-off between the expanded casing string and the wall of the borehole.

The method and apparatus of the present invention is useful for forming and installing a multi-staged casing string comprising a plurality of casing strings including a first casing string of a given diameter installed and cemented into an upper interval in a borehole, followed by a second and expandable casing string positioned in a lower interval of the borehole by passing the expandable casing string through the bore of the earlier-installed casing string. The second and expandable casing string is fitted with expandable centralizers that are installed and collapsed at the surface, and then later deployed within the borehole, in accordance with the above-described method of the present invention. After the second, expandable casing string is expanded within the lower interval of the borehole to a larger diameter that is equal to or closer to the diameter of the earlier-installed casing string, the expanded casing string is cemented into the lower interval to form what may be considered to be an extension of the earlier-installed casing string. This process may be repeated to further extend the multi-staged casing string.

In one embodiment, one or more restraining bands may be employed to restrain the bow springs of the expandable centralizer in the collapsed position to generally lie along at least a portion of the length of the expandable casing string as the expandable casing string is run into and positioned within the borehole. Each restraining band may be adapted for being slidably installed onto the exterior surfaces of the collapsed bow springs by sliding the band over the expandable collar and past the ends of the bow springs where they connect to the expandable collar, and onto the bow springs to restrain the bow springs in the generally collapsed configuration. In one embodiment, the restraining band may be mechanically or metallurgically compromised to fail upon expansion of the restraining band at a strategically selected location on the band, such as at a point opposite a coupling that secures the band to one of the bow springs. The band may be mechanically predisposed to fail at a predetermined location on the band by notching, milling, drilling, puncturing, flattening or crimping the band prior to or after installation on the expandable centralizer. The band may be metallurgically predisposed to failure at a predetermined location on the band by heat treating or acidizing the band prior to or after installation on the expandable centralizer.

In one embodiment of the centralizer of the present invention, the collars and the bow springs of the expandable centralizer may be integrally formed from a unitary piece of tubular by using a laser to cut elongate coupons of steel or other material from a tubular segment to form a cage, using an expansion tool to bend the cage ribs into an outwardly bowed configuration, and heat treating the resulting centralizer to relieve stresses imparted by the laser cutting or bowing process. The resulting expandable bow spring centralizer may be more resistant to separation of the ends of the bow springs from the collars when integrally formed in this manner, and a more detailed description of the expandable centralizer formed in this manner may be obtained from U.S. patent application Ser. No. 11/749,544, which is incorporated by reference.

The expandable centralizer of the present invention may be made from steels or common or specialty steel alloys, particularly AISI (American Iron and Steel Institute) 4140 Steel, 8620 Steel, 6150 Steel, 4340 Steel, 4130 Steel, and 4150 Steel, among others. The restraining bands may be of the same material(s), but having a relatively thin, necked, notched, milled or drilled section that is not particularly adapted for expansion along with the collars of the expandable centralizer, or the restraining bands may be of a much less ductile material that ruptures prior to appreciable expansion.

The restraining band may be pre-formed into a continuous and generally circular band prior to installation onto the bow springs of the expandable centralizer to restrain the bow springs in their collapsed configuration, or it may be formed from an elongate strip of material that is drawn into a continuous and generally circular band as it is installed on the bow springs of the expandable centralizer, as with a banding tool. For example, a continuous restraining band may be produced by cutting a segment from a seamless tubular member. For the installation of pre-formed restraining bands, a tool may be used to engage, collapse and secure the bow springs of the expandable centralizer in the generally collapsed configuration so that the band may be installed to restrain the bow springs in the collapsed configuration.

One consideration that favors the use of pre-formed restraining bands is that there is very little clearance between the restraining band and the casing string, and most banding tools require at least some clearance underneath the band being installed or tightened. Typically, the expandable centralizer will have a low-clearance design so that it will consume very little annular space between the interior wall of the earlier-installed casing string and the exterior wall of the expandable casing string that is positioned in the borehole by passing it through the earlier-installed casing string. These low-clearance centralizers, like that disclosed in U.S. patent application Ser. No. 11/749,544, are specifically designed to provide very little clearance between the collapsed bow springs and the exterior of the casing string on which the centralizer is installed.

In one embodiment, one or more of the bow springs of the expandable centralizer of the present invention may comprise one or more channels milled into its exterior to receive and retain the restraining band. For example, a channel measuring 0.5 inches wide and 0.1 inch in depth may be milled into an exterior surface of a bow spring, and a corresponding channel may be milled into the same location on the exterior surfaces of the other five bow springs of a six bow spring expandable centralizer. After a tool is used to collapse the bow springs to lie generally along at least a portion of the length of the expandable casing string on which the expandable centralizer is installed, a preformed restraining band may be slidably installed by sliding the restraining band over the expandable collar at one end of the expandable centralizer, past the connections between the ends of the bow springs and the collar, up onto the normally bowed portions of the bow springs and into the generally aligned milled channels in the bow springs. The restraining band will settle into the milled channels and be secured therein against removal from the restraining position on the bow springs by the edges of the channels.

Optionally, the tensile bands may be coupled to one or more bow springs to prevent separation of the band from the centralizer. The separated band may become lodged in critical equipment, such as BOPs. The bands may be secured to the centralizer using an adhesive, an interference fit in the channel, a fastener such as a screw, or a pin on the bow spring for being received into one or more bendable ears formed into a portion of the band. It should be recognized that a bendable ear on a band may be bent after the band is installed on the bow springs to engage and receive a pin formed into one of the bow springs. In this method, the feature that secures the band to the expandable centralizer to prevent separation of the ruptured band from the expanded centralizer does not consume any annular space or interfere with installation of the restraining band.

Although, the embodiment of the present invention disclosed and described in connection with the appended drawings illustrates the use of the method and apparatus of the present invention to install a second interval of casing within a multi-staged casing string, it should be recognized that the present invention may also be used to install any portion of a multi-staged casing string. The installation of a casing string having multiple portions sequentially installed at increasing borehole depth intervals is specifically included within the scope of the claims that follow.

The expandable centralizer of the present invention may be secured to the casing segment using any of the known methods of securing a centralizer in place on a pipe. Preferably, a low clearance method is used to minimize the annular clearance consumed. Specifically, an embodiment of the expandable centralizer of the present invention may comprise extendable collars of the invention disclosed in the parent application from which the application depends. Alternately, an embodiment of the expandable centralizer of the present invention may comprise a centralizer securable on the casing string using an epoxy secured stop collar or, more preferably, an epoxy secured web collar as described in U.S. patent application Ser. Nos. 11/422,696 and 11/428,712, respectively. Alternately, the expandable centralizer of the present invention may be secured to the casing string on which it is installed using an interference fit between the bow springs of the centralizer and the casing string that is disposed to grip the casing string upon collapse of the bow springs. Specifically, upon collapse of the bow springs of a centralizer designed for being secured in this manner, an interior portion of each bow spring adjacent to or near the coupling between each end of a bow spring the collar is disposed, upon collapse of the bow spring, radially inwardly to contract and forcibly bear against the exterior surface of a casing string received within the aligned collars of the bow spring. This manner of securing an expandable centralizer on the casing string may provide for numerous points of gripping contact between the collapsed centralizer and the casing string. Deployment of the expandable centralizer after the casing string is positioned in the targeted downhole interval of the borehole may release the expandable centralizer from the casing string, but the deployed centralizer will engage the wall of the borehole and center the casing string.

Figure 1:
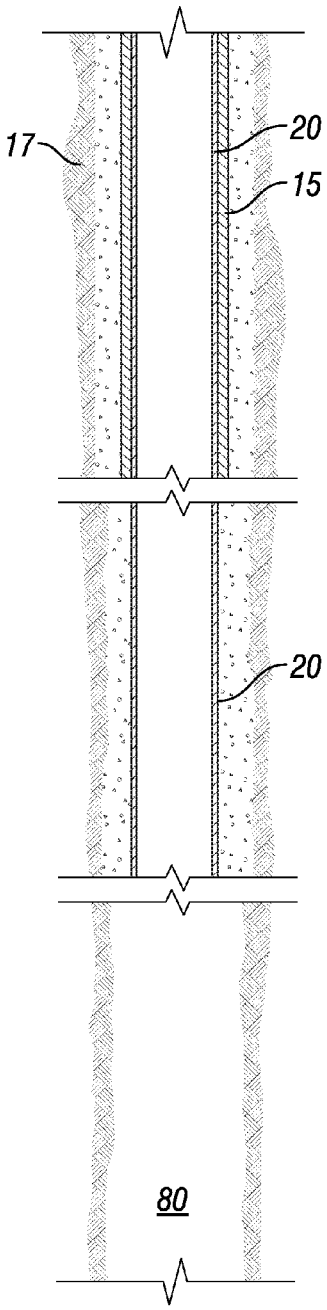
FIG. 1 is an elevation view of a previously installed first interval of a casing string installed according to the present invention. The lower, second interval has been bored, but remains uncased.

Turning to the appended drawings that illustrate one embodiment of the centralizer and method of the present invention, a centralizer and method of extending a multi-staged casing string is disclosed and illustrated. FIG. 1 is an elevation view of a previously installed first interval of a multi-staged casing string installed according to the present invention. FIG. 1 shows a borehole 80 drilled into the earth 17 and partially cased using an earlier-installed string 20 of casing. The earlier-installed string 20 may be cemented within the borehole, and a portion of the earlier-installed casing string may be secured within an outer casing 15. The lower, second interval 70 of the borehole may be drilled through the earlier-installed string 20 to prepare the borehole for extension of the earlier-installed string 20 using the method and centralizer of the present invention.

Figure 2:
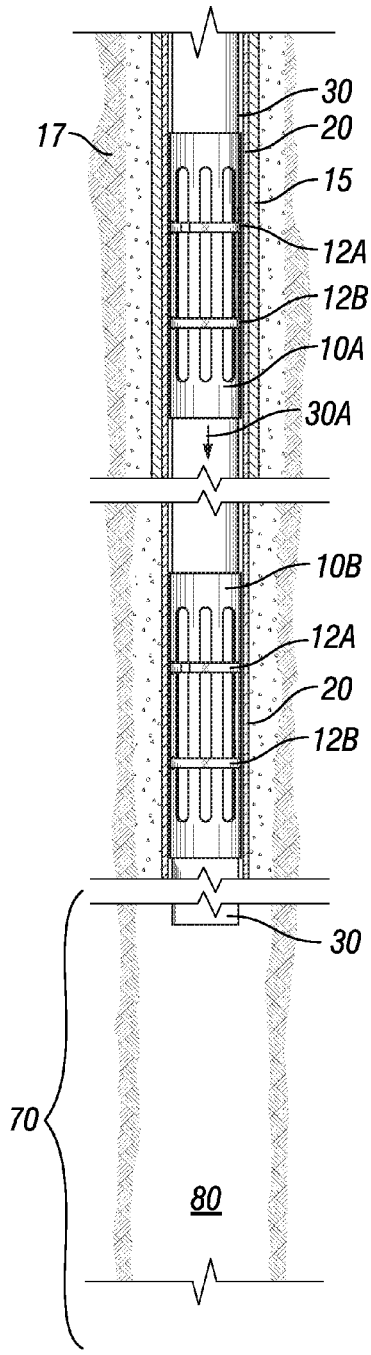
FIG. 2 is the elevation view of FIG. 1 after an expandable casing string fitted with expandable centralizers, with bow springs restrained in the collapsed configuration in accordance with one embodiment of the method of the present invention, is introduced into the borehole through the bore of a previously installed casing string.

FIG. 2 is the elevation view of FIG. 1 after an expandable casing string 30 fitted with expandable centralizers 10A and 10B of the present invention, both centralizers restrained in the collapsed configuration in accordance with one embodiment of the method of the present invention. The expandable casing string 30 and the centralizers 10A and 10B are together introduced into the borehole 80 through the bore of the earlier-installed string 20. The expandable centralizers 10A and 10B are received onto the expandable casing string 30 prior to being inserted into the first interval 20, and the expandable centralizers 10A and 10B are shown in FIG. 2 to be receivable within the annulus between the exterior wall of the expandable casing string 30 and the interior wall of the earlier-installed string 20. The expandable centralizers 10A and 10B are slidable, along with the expandable casing string 30 to which they are secured, within the bore of the earlier-installed string 20 so that the expandable casing string 30 is positionable within the drilled second interval 70 of the borehole 80.

Figure 3:
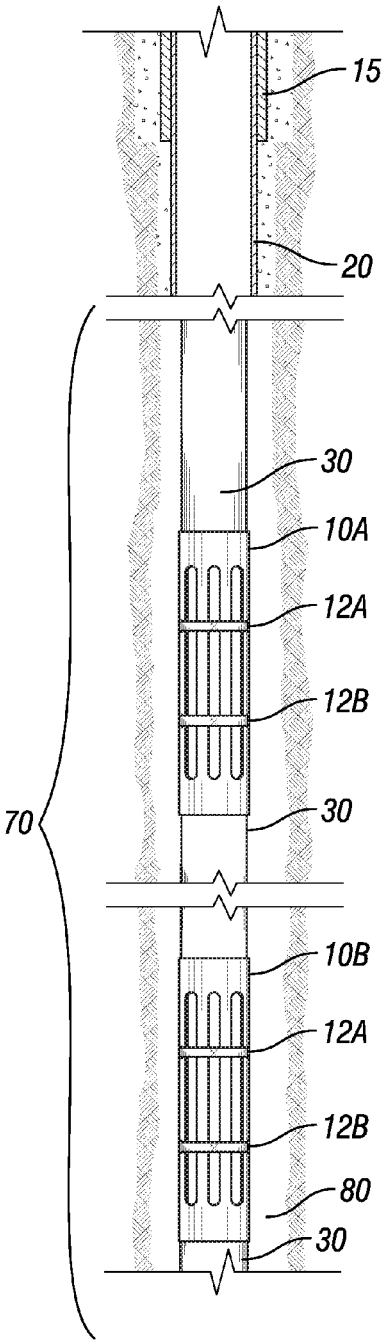
FIG. 3 is the elevation view of FIG. 2 after the expandable casing string fitted with expandable centralizers is positioned within the targeted, second interval of the borehole beneath the previously installed casing string at the first interval of the casing string.

FIG. 3 is the elevation view of FIG. 2 after the expandable casing string 30 fitted with expandable centralizers 10A and 10B is positioned within the targeted second interval 70 of the borehole 80 beneath the previously installed earlier-installed string 20 of the multi-staged casing string made according to the method of the present invention and using the centralizers of the present invention. The expandable centralizers 10A and 10B are shown remaining in the collapsed, restrained and undeployed configurations.

Figure 4:
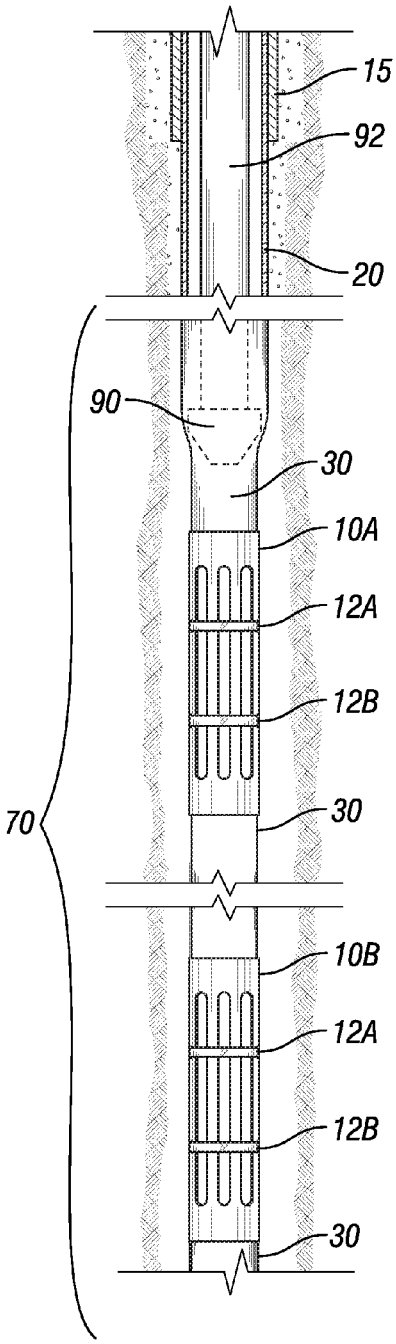
FIG. 4 is the elevation view of FIG. 3 after an expansion mandrel is positioned near the top end of the expandable casing string for use in expanding the expandable casing string and fitted expandable centralizers to deploy the centralizers within the borehole.

FIG. 4 is the elevation view of FIG. 3 after an expansion mandrel 90 is positioned near the top end of the expandable casing string 30 for use in expanding the expandable casing string 30 along with the expandable centralizers 10A and 10B to deploy the centralizers within the borehole 80. The expansion mandrel 90 is run into the borehole 80, positioned and forcibly moved through the bore of the expandable casing string 30 using drill pipe 92 which may comprise a plurality of drill collars for moving the expansion mandrel 90 downwardly through the bore of the expandable casing string 30 to radially expand the expandable casing string to a diameter that generally matches the diameter of the earlier-installed string 20.

Figure 5:
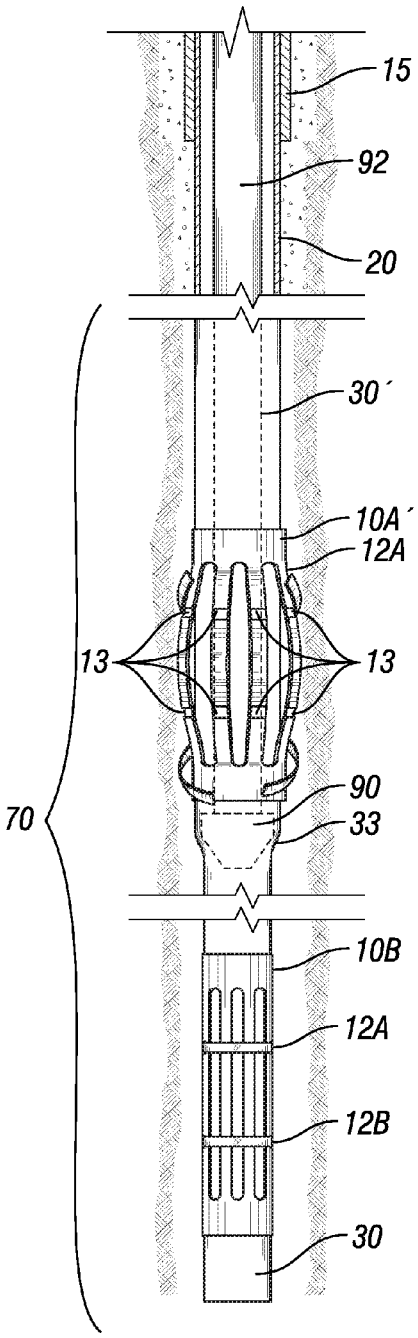
FIG. 5 is the elevation view of FIG. 4 after the expansion mandrel is forced through an upper portion of the expandable casing string in accordance with one embodiment of the method of the present invention and at least one expandable centralizer is expanded and deployed to center at least a portion of the expanded casing string within the borehole.

FIG. 5 is the elevation view of FIG. 4 after the expansion mandrel 92 is forced through an upper portion 31 of the expandable casing string 30 in accordance with one embodiment of the method of the present invention and at least one expandable centralizer 10A' is shown to be expanded and by the expansion mandrel 90 and deployed to center at least the upper portion 31 of the expandable casing string 30 within the borehole 80. The expandable centralizer 10A' is shown to have radially outwardly deployed bow springs 14 that deploy upon rupture of the restraining bands 12A' and 12B'. The expansion mandrel 90 is shown positioned below the deployed and expanded centralizer 10A' as it moves the transition 33 further down the expandable casing string 30.

Figure 6:
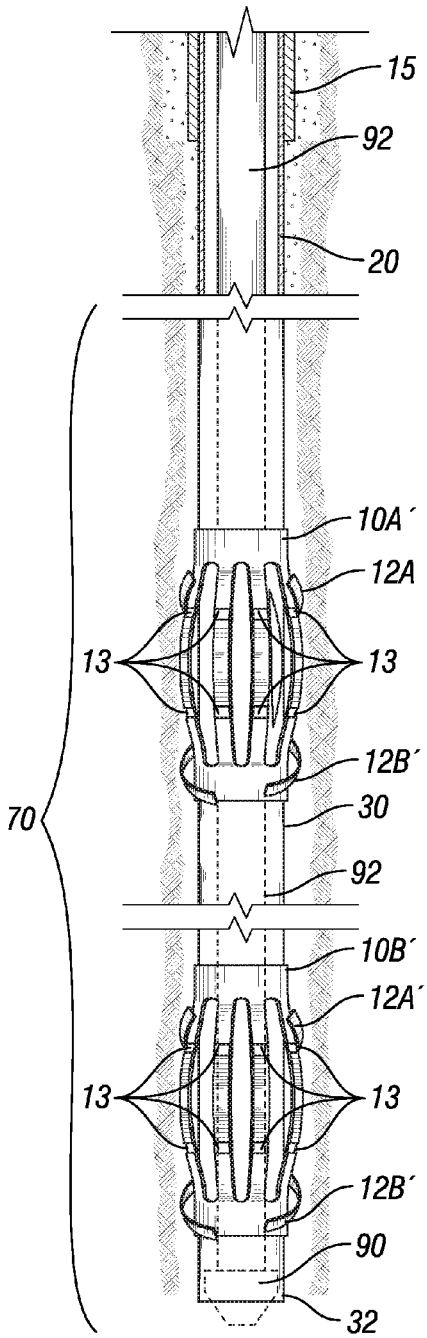
FIG. 6 is the elevation view of FIG. 6 after the expansion mandrel is forced through the remaining lower portion of the expandable casing string to expand and deploy the remaining centralizer(s) to center the expanded casing string within the borehole.

FIG. 6 is the elevation view of FIG. 5 after the expansion mandrel 92 is forced through the remaining lower portion 32 of the expandable casing string 30 to expand and deploy the remaining expandable centralizer(s) 10B' and center the expanded casing string 30' within the borehole 80. The expansion mandrel 90 is shown at the bottom of the expanded casing string 30' and ready to be withdrawn from the borehole 80. The expanded casing string 30' is ready for being cemented into the second interval 70 of the borehole 80 by pumping downwardly cement through the now-expanded bore of the expanded casing string 30' and back up the second interval 70 of the borehole 80 through the annulus between the borehole 80 and the exterior surface of the expanded casing string 30'.

FIG. 7 is an enlarged elevation view of an expandable centralizer 10 of FIG. 4. The expandable centralizer 10 comprises a pair of opposed expandable collars 11 and a plurality of bow springs 14, each coupled at each end to a collar 11. The bow springs 14 are restrained in their collapsed configuration by restraining bands 12A and 12B. The restraining bands 12A and 12B are positioned on the bow springs 14 within shallow channels 13 milled in the exterior surfaces of the bow springs 14 and aligned one with the others to receive and secure the restraining bands 12A and 12B in position on the expandable centralizer 10.

FIG. 8 is the enlarged elevation view of the expandable centralizer 10' of FIG. 7 after the expansion mandrel 92 (not shown in FIG. 8—see FIGS. 5 and 6) has been forcibly moved through the bore of the expandable casing string 30' and through the expandable centralizer 10' to expand the expandable casing string 30' and the expandable collars 11' of the expandable centralizer 10', and to rupture the restraining bands 12A' and 12B' to release the bow springs 14 of the expandable centralizer 10' to their radially outwardly deployed configuration. The rupture of the restraining bands 12A' and 12B' reveal the milled shallow channels 13 in the exterior surfaces of the bow springs 14 for receiving, positioning and retaining the restraining bands 12A and 12B (see FIG. 7).

FIG. 9A is a perspective view of an expandable centralizer 10 of the present invention with a collapsing tool 26 having a variable loop 27 disposed generally around the deployed middle portion 14A of the bow springs 14 for forcing the bow springs to a collapsed configuration to facilitate the slidable installation of restraining bands 12A and 12B. The variable loop 27 is coupled to the handle 28 so that the handle 28 can be used to forcibly ratchet the loop 27 and constrict the loop to a smaller diameter.

FIG. 9B is the perspective view of the expandable centralizer 10 of FIG. 9A after the collapsing tool 26 has been used to partially collapse the bow springs 14 to their collapsed configuration. The handle 28 is shown ratcheted from its position shown in FIG. 9A.

FIG. 9C is the perspective view of the expandable centralizer 10 of FIG. 9C after the collapsing tool (not shown in FIG. 9C) has been used to completely collapse the bow springs 14 of the expandable centralizer 10 of the present invention, and the restraining bands 12A and 12B have been slidably installed onto the collapsed bow springs 14, and received and retained within milled channels 13 (see FIG. 9B) on the exterior surface of the bow springs 14 to retain the bow springs in their collapsed configuration. A restraining band 12A is illustrated as coupled to a bow spring 14 using a screw 99, as described above, to prevent separation of the restraining band 12A from the centralizer 10.

It should be understood that the expandable centralizer of the present invention is not limited to any particular number of bow springs, or to any particular method of coupling the bow springs to the expandable collars, and that the embodiment shown in the appended drawings is an exemplary embodiment. Similarly, the placement of the restraining bands in locations other than the locations shown in the appended drawings is within the scope of the present invention, and the use of milled shallow channels to receive, position and retain the restraining bands prior to rupture is optional.

It should further be understood that the appended drawings represent an idealized deployment of the bow springs of the expandable centralizer of the present invention, and that various factors could result in the stand-off provided by some deployed bow springs on one side of the expandable centralizer being less than the stand-off provided by other deployed bow springs on the other side of the expandable centralizer. For example, if the expandable casing string on which the expandable centralizer of the present invention is secured is installed in a targeted interval of the borehole that is non-vertical. In this interval, gravity may cause the bow springs on one side to provide less stand-off than is provided by the bow springs on the other side of the expanded centralizer.

The terms "comprising," "including," and "having," as used in the claims and specification herein, indicate an open group that includes other elements or features not specified. The term "consisting essentially of," as used in the claims and specification herein, indicates a partially open group that includes other elements not specified, so long as those other elements or features do not materially alter the basic and novel characteristics of the claimed invention. The terms "a," "an" and the singular forms of words include the plural form of the same words, and the terms mean that one or more of something is provided. The terms "at least one" and "one or more" are used interchangeably.

The term "one" or "single" shall be used to indicate that one and only one of something is intended. Similarly, other specific integer values, such as "two," are used when a specific number of things is intended. The terms "preferably," "preferred," "prefer," "optionally," "may," and similar terms are used to indicate that an item, condition or step being referred to is an optional (not required) feature of the invention.

It should be understood from the foregoing description that various modifications and changes may be made in the preferred embodiments of the present invention without departing from its true spirit. The foregoing description is provided for the purpose of illustration only and should not be construed in a limiting sense. Only the language of the following claims should limit the scope of this invention.

We claim:

1. A method of deploying an expandable bow spring centralizer installed on an expandable casing string, restrained in a collapsed configuration by one or more bands, and deployable within a borehole to provide stand-off between the expanded casing string and the borehole, the method comprising the steps of:

expanding the expandable casing string within a targeted interval of the borehole;

rupturing the one or more bands to release the bow springs; and securing the one or more bands to the one or more bow springs to prevent separation of the ruptured band from the centralizer.

2. The method of claim 1 further comprising the step of:

selecting a band material of the one or more bands that is less ductile than a material of the expandable casing string.

3. The method of claim 1 wherein the number of bands is two.

4. The method of claim 1 further comprising the step of:

puncturing, drilling, crimping, or heat treating at least a portion of the one or more bands.

5. A method of deploying an expandable bow spring centralizer installed on an expandable casing string, restrained in a collapsed configuration by one or more bands, and deployable within a borehole to provide stand-off between the expanded casing string and the borehole, the method comprising the steps of:

expanding the expandable casing string within a targeted interval of the borehole;

rupturing the one or more bands to release the bow springs; and providing at least one of the one or more bands having at least a portion thereof that is at least one of milled, channeled, notched, necked and heat treated.

6. An expandable centralizer to provide stand-off between a borehole and an expanded casing string comprising:

a first expandable collar and a second expandable collar;

a plurality of bow springs coupled at a first end to the first expandable collar and at a second end to the second expandable collar;

at least one landing formed into the radially exterior surface of at least one of the bow springs to receive and retain a band to restrain the bow springs in a collapsed configuration;

wherein the band comprises a portion that is at least one of notched, necked, punctured, drilled, crimped, and heat treated.

7. The apparatus of claim 6 wherein the landing portion is a milled channel.

8. The apparatus of claim 6 wherein the landing portion is a surface depression.

9. The centralizers of claim 6 wherein the centralizer comprises a first extendable collar and a second extendable collar.

10. The centralizer of claim 9 wherein the first extendable collar, the second extendable collar and the bow springs are formed from unitary piece of tubular pipe.

11. The centralizer of claim 6 wherein the centralizer comprises a first connection between the first end of a bow spring and the first expandable collar and a second connection between the second end of the bow spring and the second expandable collar that are adapted to resist failure upon expansion of the first and second collars and the casing string.

12. The centralizer of claim 11 wherein the bow springs are integral with the first collar and the second expandable collars.

13. The centralizer of claim 11 wherein the first expandable collar, the second expandable collar and the bow springs are formed from a unitary piece of tubular pipe.

14. An expandable centralizer to provide stand-off between an expanded casing string and a borehole comprising:

one or more sacrificial bands to restrain a plurality of bow springs of the centralizer in a collapsed configuration, wherein the one or more sacrificial bands are predisposed to rupture upon expansion of the expandable casing string within a predetermined range of expandability to release the bow springs to a deployed configuration, and wherein the at least one of the bands comprises a portion that is at least one of notched, necked, channeled, milled, and heat treated.

15. The centralizer of claim 14 wherein the at least one of the bands comprises a material having less ductility than a material of the expandable casing string.

16. An expandable centralizer to provide stand-off between an expanded casing string and a borehole having at least one expandable collar coupled to a first end of a plurality of bow springs, the expandable centralizer comprising:

one or more bands to restrain the plurality of bow springs in a collapsed configuration, wherein the one or more bands are predisposed to rupture upon expansion of the expandable casing string within a predetermined range of expandability to release the bow springs to a deployed configuration, and wherein the at least one of the bands comprises a portion that is at least one of notched, necked, channeled, milled, and heat treated.

17. The centralizer of claim 16 wherein the at least one of the bands comprises a material that is less ductile than a material of the expandable casing string.

* * * * *